US008011536B2

(12) United States Patent
Witschke et al.

(10) Patent No.: US 8,011,536 B2
(45) Date of Patent: Sep. 6, 2011

(54) DEVICE FOR PROVIDING A COOLED OR HEATED LIQUID ONBOARD AN AIRCRAFT

(75) Inventors: Matthias Witschke, Hamburg (DE); Wolfgang Ebigt, Hamburg (DE); Marco Mundt, Heiligengrabe (DE); Peter Detjen, Hamburg (DE)

(73) Assignee: Airbus Deutschland GmbH, Hamburg (DE)

( * ) Notice: Subject to any disclaimer, the term of this patent is extended or adjusted under 35 U.S.C. 154(b) by 698 days.

(21) Appl. No.: 11/996,900

(22) PCT Filed: Aug. 3, 2006

(86) PCT No.: PCT/EP2006/007701

§ 371 (c)(1),
(2), (4) Date: Jun. 30, 2008

(87) PCT Pub. No.: WO2007/017185

PCT Pub. Date: Feb. 15, 2007

(65) Prior Publication Data

US 2009/0308577 A1 Dec. 17, 2009

(30) Foreign Application Priority Data

Aug. 4, 2005 (DE) ..... 10 2005 036 861

(51) Int. Cl.
*B67D 7/80* (2010.01)

(52) U.S. Cl. ..... 222/146.1; 222/1; 62/324.1; 62/399; 62/904; 165/104.14; 165/104.22; 165/104.28; 165/108; 165/156; 165/184

(58) Field of Classification Search .... 222/146.1–146.2, 222/146.6, 1; 165/104.11–104.34, 108, 156, 165/164, 184; 62/324.1–325, 338–339, 389, 399, 904

See application file for complete search history.

(56) References Cited

U.S. PATENT DOCUMENTS 3,739,842 A * 6/1973 Whalen ..... 165/164

(Continued)

FOREIGN PATENT DOCUMENTS

DE 3334103 4/1985

(Continued)

OTHER PUBLICATIONS

English Translation of Decision on Granting a Patent for Invention, Russian Patent Office, Jul. 28, 2009.

(Continued)

*Primary Examiner* — Frederick C Nicolas
*Assistant Examiner* — Andrew Bainbridge
(74) *Attorney, Agent, or Firm* — Wood, Herron & Evans, LLP

(57) ABSTRACT

A dispenser of cooled or heated liquid which in one embodiment is a server cart for an aircraft. To avoid the need for a pump, the reservoir has a cooling or heating heat exchanger that helically coils around the main reservoir, which cools from the top down or heats from the bottom up, forming a counter current. The reservoir is connected to at least two conduits, one near the cooler top of the reservoir and one near the relatively warmer bottom of the reservoir. The two conduits connect to one another at a distance from the reservoir forming a dispensing passage, thereby allowing fluid to constantly circulate through the dispensing passage due to difference in the specific gravity in the fluid caused by the temperature difference. The elimination of the pump device is especially desirable for weight sensitive environments such as an aircraft.

20 Claims, 1 Drawing Sheet

U.S. PATENT DOCUMENTS

| | | | |
|---|---|---|---|
| 5,927,091 | A | 7/1999 | Hong |
| 2003/0012564 | A1 | 1/2003 | Brache |
| 2004/0112079 | A1 | 6/2004 | Omuta et al. |

FOREIGN PATENT DOCUMENTS

| | | |
|---|---|---|
| DE | 9004046 | 3/1991 |
| DE | 29720326 | 3/1998 |
| DE | 10341523 | 4/2005 |
| EP | 0336751 | 10/1989 |
| EP | 0472276 | 2/1992 |
| EP | 1520783 | 4/2005 |
| FR | 2679631 | 1/1993 |
| JP | 2004061013 | 2/2004 |
| WO | 2004085927 | 10/2004 |

OTHER PUBLICATIONS

First page of RU 2115876 C1, Jul. 20, 1996, and an English language translation of the Abstract.
English language translation of the first page of KR 100321583 B1, Jan. 9, 2002, including Abstract.
International Search Reports, Form Nos. PCT/ISA/220, PCT/ISA/210, and PCT/ISA/237.

* cited by examiner

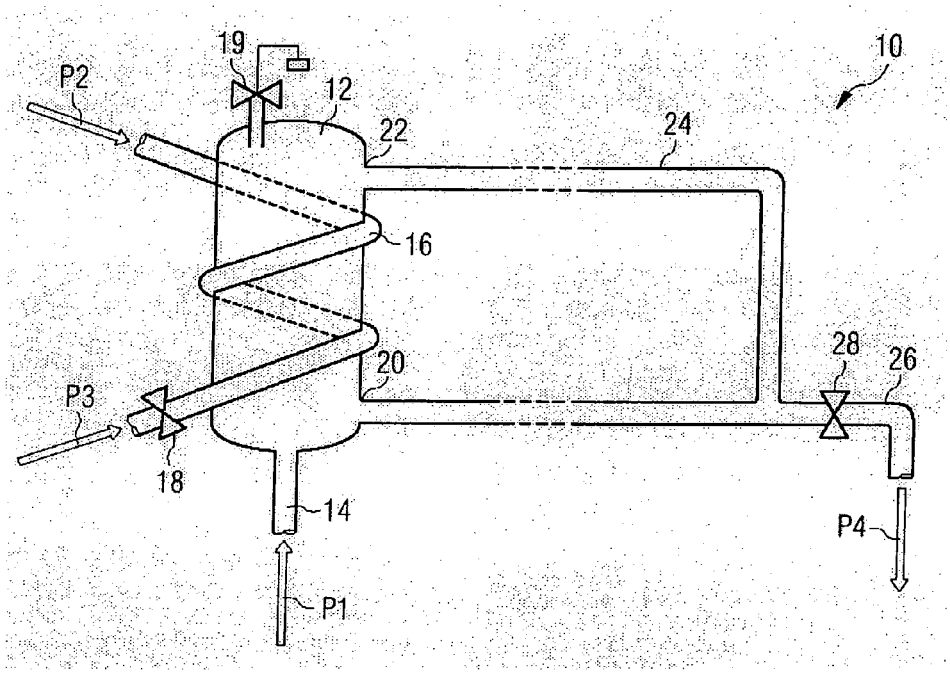
19
P2
12
22
24
10
16
20
28
26
P3
18
14
P4
P1

DEVICE FOR PROVIDING A COOLED OR HEATED LIQUID ONBOARD AN AIRCRAFT

TECHNICAL FIELD

The invention relates to an aircraft liquid provisioning device for providing a cooled or heated liquid onboard an aircraft, which comprises a reservoir for receiving the liquid to be cooled or to be heated.

BACKGROUND

In order to supply all passengers onboard an aircraft with adequately cooled drinking water, usually several drinking water provisioning devices are provided in the area of the aircraft's passenger cabin. Each of these drinking water provisioning devices comprises a reservoir connected with a central drinking water supply system for the intermediate storage of the fed-in drinking water from the drinking water supply system. For the purpose of cooling down the intermediately stored drinking water in is the reservoir to a desired dispensing temperature, a refrigerating machine is employed. The drinking water in the reservoir may for example, be cooled down to the desired dispensing temperature by means of a cold steam process using a compressor, or by means of Peltier elements. The waste heat which is generated thereby is exhausted to the ambient air and usually has to be drawn off by means of an evacuation system in order to ensure an adequate air exchange in the area of the refrigerating machine and the reservoir and to avoid the overheating of the refrigerating machine as well as of further components which are arranged in the environment of the refrigerating machine. When the drinking water which is intermediately stored in the reservoir has reached the desired cool dispensing temperature, the drinking water may be withdrawn via a dispensing point which is normally arranged in an immediate spatial vicinity to the reservoir.

Such known drinking water provisioning devices are disadvantageous in that the refrigerating machine as well as the evacuation system for drawing off the waste heat generated by the refrigerating machine have a relatively high weight and a relatively large installation volume. Moreover, their installation and, in particular, their integration into the installation space which is available on board an aircraft to a limited extent only, might be very complicated and require a high constructive expenditure. Finally, a spatial separation of the dispensing point from the reservoir containing the cooled drinking water is not possible, because the water which is contained in a conduit for connecting the dispensing point with the reservoir would be heated due to the higher ambient temperature. At least at the beginning of a dispensing operation, the water which is withdrawn at the dispensing point then would not have the desired cool temperature.

DE 33 34 103 A1 discloses a hot water supply device comprising a water heater which is connected with a cold water supply conduit. The water heater is connected with dispensing points via a supply conduit. From the dispension points a gravity circulation conduit leads back to the water heater.

From DE 90 04 046 U1 a device for heating or cooling of liquids is known, which comprises a reservoir for the heated or cooled liquid. Heating or cooling means may be arranged within the reservoir, either completely or with their heat exchanging components only. Alternatively, heating or cooling means may also be provided outside the container in the case of a reservoir which is employed as buffer container, with the container being connected in series to conduits of a heat circuit or a coolant circuit. A hot water boiler described in DE 90 04 046 U1 comprises heating means which are formed as a heat exchanger and are arranged in the reservoir interior, and which are connected with a hot water circuit of a building heating system.

DE 297 20 326 U1 describes an arrangement for heating the circulation water in a drinking water reservoir, wherein water which is contained in a reservoir is heated by a heating coil which is arranged in the reservoir or by a plate heat transfer means which is arranged outside the reservoir.

From DE 103 41 523 A1 a hot water boiler is known which is intended for use in an aircraft and operated as a flow heater.

SUMMARY OF THE INVENTION

The invention is based on the object to provide a compactly constructed device for providing a cooled or heated liquid, which is particularly suited for the use onboard an aircraft.

To solve this object, a reservoir of an inventive aircraft liquid provision device for providing a cooled or a heated liquid onboard an aircraft is thermally coupled with a conduit through which a cooling medium or a heat transfer medium may flow. As the cooling medium e. g. a gaseous or liquid refrigerating medium such as e. g. glycol or the like may be used. By the thermal coupling of the reservoir with the conduit through which the cooling medium or the heat transfer medium may flow, the liquid contained in the reservoir may be cooled to the desired temperature due to the heat transfer from the liquid to the cooling medium or heated to the desired temperature due to the heat transfer from the heat transfer medium to the liquid during operation of the inventive device for providing a cooled or heated liquid. The utilisation of a separate refrigerating machine for the generation of cooled drinking water onboard an aircraft is therefore no longer required because of the inventive device for providing a cooled or heated liquid. This also allows to omit an evacuation system for drawing off the waste heat generated by the refrigerating machine. Consequently, the inventive device comprises a simple and compact construction which is advantageous, in particular for the installation into the installation space in an aircraft, which is available to a limited extent only.

The reservoir comprises a first and second circulation connection, with the first circulation connection being connected with the second circulation connection via a is circulation conduit. Due to the constructive arrangement of the inventive device for providing a cooled or heated liquid with a reservoir which is thermally coupled with a conduit through which a cooling medium or a heat transfer medium may flow, a temperature gradient develops in the liquid contained in the reservoir. Due to the temperature dependency of the density of liquids, this temperature gradient inevitably results in a density gradient in the liquid contained in the reservoir so that a gravity-induced circulation of the liquid contained in the reservoir from the first circulation connection through the circulation circuit towards the second circulations connection sets in. In this manner, the liquid contained in the reservoir can be delivered through the circulation conduit to a location remote from the reservoir without using additional components such as e. g. a pump or the like. Moreover, a continuous flow of the liquid in the circulation conduit is ensured, so that no perceptible temperature change of the liquid in the circulation conduit due to environmental influences will occur.

The conduit through which the cooling medium or the heat transfer medium may flow extends essentially helically about the reservoir. This enables a particularly compact construction of the inventive device for providing a cooled or heated liquid, and at the same time a particularly efficient heat transfer is ensured between the liquid in the reservoir, which has to be cooled or heated, and the cooling medium or the heat transfer medium. The reservoir and the conduit through which the cooling medium or the heat transfer medium may flow, may be designed as separate components, Alternatively, however, it is also possible to design a e. g. cylinder-shaped reservoir and a conduit extending essentially helically about the reservoir, through which a cooling medium or a heat transfer medium may flow, as an integrated component.

The reservoir and the conduit, through which the cooling medium or the heat transfer medium may flow, of the inventive device for providing a cooled or heated liquid are preferably adapted to form a heat exchanger. The reservoir and the conduit through which the cooling medium may flow may be designed as separate components, but may optionally be designed integrated with each other to form a single component. Preferably, the reservoir and the conduit through which the cooling medium or the heat transfer medium may flow consist of a heat conductive material, such as e. g. a metal. Thus an optimum heat transfer between the liquid to be cooled or heated, which is contained in the reservoir, and the cooling medium or the heat transfer medium is ensured.

In a particularly preferred embodiment of the inventive device for providing a cooled or heated liquid, the heat exchanger formed by the reservoir and the conduit, through which the cooling medium or the heat transfer medium may flow, works on the countercurrent principle, i.e. the cooling medium or the heat transfer medium flows in a first direction through the corresponding conduit, while the liquid to be cooled or heated which circulates in the reservoir and the circulation conduit, flows in a second direction opposite to the first flow direction. Such a heat exchanger working on the countercurrent principle is characterised by a high efficiency and therefore enables the inventive device to operate especially energy-efficient.

In a preferred embodiment of the inventive device for providing a cooled or heated liquid, a first flow control valve is arranged in the conduit through which the cooling medium or the heat transfer medium may flow. This flow control valve which, for example, may be designed in the form of a solenoid valve which is controlled by an electronic control unit, enables to control the flow rate of the cooling medium or the heat transfer medium through the respective conduit, and thus to control the desired temperature of the liquid to be cooled or heated which is contained in the reservoir. For example, a temperature sensor or several temperature sensors for measuring the temperature of the liquid fed to the reservoir and/or the liquid in the reservoir may be provided. Signals which are output by the temperature sensor(s) may then be utilized for controlling the flow control valve arranged in the conduit through which the cooling medium or the heat transfer medium may flow in order to control the flow rate of the cooling medium or the heat transfer medium and thus the temperature of the liquid in reservoir, as desired.

Preferably, the conduit of the inventive device for providing a cooled or heated liquid, through which the cooling medium or the heat transfer medium may flow forms a part of a conduit system through which a cooling medium or a heat transfer medium may flow. Such a conduit system may e. g. be connected with several devices for providing a cooled or heated liquid onboard an aircraft. A first part of the conduit system will then be e. g. thermally coupled with a reservoir of a first device for providing a cooled or heated liquid. A second part of the conduit system may, however, extend from the first device for providing a cooled or heated liquid to a second device for providing a cooled or heated liquid. A third part of the conduit system may finally be thermally coupled with a reservoir of the second device for providing a cooled or heated liquid. Such an arrangement is advantageous in that only one delivery means which may be designed in the form of a pump is required for delivering the cooling medium or the heat transfer medium through the conduit system which is connected with several devices for providing a cooled or heated liquid.

Preferably, the reservoir of the inventive device for providing a cooled or heated liquid comprises an inlet connection for the supply of the liquid to be received in the reservoir into the reservoir. This inlet connection may be connected with a drinking water supply system of an aircraft. If desired, another flow control valve may be provided in the area of the inlet connection of the reservoir in order to control the supply of the liquid to be received in the reservoir.

The arrangement of the inlet connection at the reservoir may depend on whether the inventive device is to be used for providing a cooled or for providing a heated liquid. If the inventive device is to be employed for providing a cooled liquid, e. g. for providing cooled drinking water onboard an aircraft, the inlet connection is preferably arranged at a lower end of the reservoir. This ensures that liquid which has a higher temperature and thus a lower density is fed into a lower portion of the reservoir, while liquid cooled down by the contact with the cooling medium flowing through the corresponding conduit and having a higher density will be in an upper portion of the reservoir. Due to gravity, the cooler liquid will sink towards the lower portion of the reservoir and thus provide for the maintenance of the liquid circulation through the circulation conduit.

Contrary to that the inlet connection of the reservoir of an inventive device which is employed for providing a heated liquid is preferably arranged in the area of an upper end of the reservoir. This again ensures that the cooler liquid with a higher density resides in an upper portion of the reservoir, while liquid which is heated by the contact with the heat transfer medium flowing through the corresponding conduit and having a lower density will be collected in a lower portion of the reservoir, Due to the gravity-induced sinking of the cooler liquid in the reservoir the liquid circulation in the circulation conduit is again ensured.

In a preferred embodiment of the inventive device for providing a cooled or heated liquid a dispensing conduit for the withdrawal of the liquid contained in the reservoir is coupled with the circulation conduit which connects the first circulation connection of the reservoir with the second circulation connection of the reservoir. Because, as explained above, a continuous flow of the liquid contained in the reservoir is ensured through the circulation conduit, any perceptible change of the liquid temperature in the circulation conduit due to environmental influences is reliably prevented. The dispensing conduit may therefore be connected with the circulation conduit at any position, i.e. also in a considerable spatial distance from the reservoir, without the risk that the liquid withdrawn from the circulation conduit via the dispensing conduit might not have the desired temperature.

In the inventive device for providing a cooled or heated liquid the reservoir and the dispensing conduit may therefore be arranged at a considerable spatial distance from one another. This makes it possible to provide a dispensing conduit and to withdraw liquid from the reservoir of the inventive device for providing a cooled or heated liquid even in those positions where there is no sufficient installation space for the reservoir available. The inventive device for providing a cooled or heated liquid therefore may be employed in a particularly flexible manner and is especially suited for use in the drinking water supply of the passengers onboard an aircraft.

It is understood that with the inventive device for providing a cooled or heated liquid also several dispensing conduits for the withdrawal of the liquid received in the reservoir may be coupled with the circulation conduit, if required.

Preferably, another flow control valve is arranged in the dispensing conduit. By means of this valve the withdrawal of the cooled or heated liquid from the reservoir of the inventive device for providing a cooled or heated liquid may be controlled as desired.

Preferably, the reservoir of the inventive device for providing a cooled or heated liquid comprises a float valve which is arranged in an upper region of the reservoir. This float valve serves both, deaerating the reservoir upon filling with the liquid to be cooled or heated, and aerating the reservoir upon draining of the liquid to be cooled or heated.

It is understood that in the inventive device for providing a cooled or heated liquid the reservoir and the conduit through which the cooling medium or the heat transfer medium may flow may be replaced by a continuous flow heat exchanger without storage capacity.

BRIEF DESCRIPTION OF THE DRAWINGS

A preferred embodiment of an inventive device for providing a cooled or heated liquid will now be explained in more detail with reference to the accompanying schematic FIGURE which illustrates a device for providing cooled drinking water, and which is particularly suited for use onboard an aircraft.

DETAILED DESCRIPTION

The FIG. shows a device 10 for providing cooled drinking water, which comprises a cylindrically shaped reservoir 12 for receiving the drinking water to be cooled. The reservoir 12 is made of a heat conductive material, such as e. g. a metal, and is provided with an inlet connection 14 at its lower end for feeding the drinking water to be cooled into the reservoir 12. The inlet connection 14 of the reservoir 12 is connected with a drinking water supply system (not shown in the FIG.) onboard an aircraft.

The device 10 further comprises a conduit 16 which extends helically about the cylindrically shaped reservoir 12, through which a cooling medium, such as e. g. glycol, may flow. The conduit 16 through which the cooling medium may flow forms part of a conduit system (not shown in detail) through which a cooling medium may flow, and which is connected with several devices 10 for providing cooled drinking water. The conduit 16 through which the cooling medium may flow also consists of a heat conductive material, such as e. g. a metal. Thereby a proper thermal coupling of the reservoir 12 with the conduit 16 through which the cooling medium may flow is ensured.

In the conduit 16 through which the cooling medium may flow a flow control valve 18 is arranged. The flow control valve 18 serves to control the flow rate of the cooling medium in the conduit 16 and thus the temperature of the drinking water to be cooled and received in the reservoir 12.

In an upper region of the reservoir 12 a float valve 19 arranged. The float valve 19 is used to ensure the automatic deaeration upon filling and the automatic aeration upon draining of the reservoir 12.

The reservoir 12 of the device 10 for providing cooled drinking water further comprises a first and a second circulation connection 20, 22. The first circulation connection 20 is connected with the second circulation connection 22 via a circulation conduit 24.

The circulation conduit 24 is coupled with a dispensing conduit 26 for withdrawing the drinking water received in the reservoir 12. In the dispensing conduit 26 a further flow control valve 28 is arranged by means of which the withdrawal of the drinking water from the reservoir 12 can be controlled as desired.

In the following, the functioning of the device for providing cooled drinking water shown in the figure will be explained in more detail. As indicated by the arrow P1 in the figure, the drinking water to be cooled is fed into the reservoir 12 through the inlet connection 14. The cooling medium, however, flows through the conduit 16 in a direction which is indicated by the arrows P2, P3. For the delivery of the cooling medium through the conduit system and the conduit 16 a pump (not shown in the figure) is used.

During operation of the device 10 for providing cooled drinking water, a heat transfer from the warm drinking water fed into the reservoir 12 through the inlet connection 14 to the cooling medium flowing through the conduit 16 takes place because of the thermal coupling of the reservoir 12 with the conduit 16 through which cooling medium may flow. This gradually decreases the temperature of the drinking water in the reservoir 12, with a temperature gradient being generated in the drinking water received in the reservoir 12. In other words, warm drinking water fed in through the inlet connection 14 resides in a lower region of the reservoir 12, while drinking water which is cooled by the heat transfer contact with the cooling medium flowing through the conduit 16 is collected in an upper region of the reservoir 12.

Because the mentioned temperature gradient due to the temperature dependency of the density of liquids inevitably results in a density gradient in the drinking water received in the reservoir 12, a gravity-driven circulation of the drinking water from an upper end of the reservoir 12 to the first circulation connection 20 and through the circulation conduit 24 towards the second circulation connection 22 takes place. Therefore, the reservoir 12 and the conduit 16 through which the cooling medium may form a heat exchanger working on the countercurrent principle.

The above described gravity-driven circulation ensures a continuous flow of the drinking water through the circulation conduit 24. Thereby any perceptible heating of the drinking water in the circulation conduit 24 by environmental influences is avoided. Drinking water which is withdrawn from the circulation conduit 24 through the dispensing conduit 26 in the direction of the arrow P4 in the figure will therefore always have the desired cool temperature, though the dispensing conduit 26 may be connected with the circulation conduit 24 in a considerable spatial distance form the reservoir 12.

The invention claimed is:

1. An aircraft liquid provisioning device for providing a cooled or heated liquid onboard an aircraft, comprising:

a reservoir that receives a liquid to be cooled or heated and includes a first upper region, a second lower region, and first and second circulation connections, the first circulation connection being located in the second lower region, the second circulation connection be in located in the first upper region;

a circulation conduit connecting the first circulation connection and the second circulation connection outside the reservoir; and a heat transfer conduit through which one of a cooling medium and a heat transfer medium may flow, the heat transfer conduit extending essentially helically about the reservoir and being thermally coupled with the reservoir, wherein the first upper region of the reservoir contains liquid which has a lower temperature than liquid in the second lower region of the reservoir, such that a temperature radient between cooler liquid located in the first upper region of the reservoir and warmer liquid located in the second lower region of the reservoir results in a gravity-driven circulation of liquid through the circulation conduit in a direction from the first circulation connection to the second circulation connection.

2. The aircraft liquid provisioning device according to claim 1, wherein the reservoir and the heat transfer conduit form a heat exchanger which works on the countercurrent principle.

3. The aircraft liquid provisioning device according to claim 1, further comprising a flow control valve arranged in the heat transfer conduit.

4. The aircraft liquid provisioning device according to claim 1, further comprising a conduit system through which a cooling medium or a heat transfer medium may flow and which is connected with several reservoirs for providing a cooled or heated liquid onboard an aircraft, the conduit system including the heat transfer conduit.

5. The aircraft liquid provisioning device according to claim 1, wherein the reservoir includes an inlet connection for receiving the liquid in the reservoir.

6. The aircraft liquid provisioning device according to claim 1, further comprising a dispensing conduit for withdrawing the liquid contained in the reservoir, the dispensing conduit being coupled with the circulation conduit.

7. The aircraft liquid provisioning device according to claim 6, further comprising a further flow control valve arranged in the dispensing conduit.

8. The aircraft liquid provisioning device according to claim 1, further comprising a float valve arranged in the first upper region of the reservoir.

9. The aircraft liquid provisioning device according to claim 1, wherein the gravity-driven circulation of liquid through the circulation conduit is continuous such that stagnation of liquid in the reservoir and the circulation conduit is avoided.

10. The aircraft liquid provisioning device according to claim 5, wherein when a cooled liquid is to be provided to the aircraft, the inlet connection is provided in the second lower region of the reservoir to receive warm liquid into the reservoir, and wherein when a heated liquid is to be provided to the aircraft, the inlet connection is provided in the first upper region of the reservoir to provide cool liquid into the reservoir.

11. A method for providing a cooled or heated liquid onboard an aircraft, the method comprising:

supplying a liquid into a reservoir including a first upper region, a second lower region, a first circulation connection located in the second lower region, and a second circulation connection located in the first upper region, the first and second circulation connections being connected by a circulation conduit;

supplying one of a cooling medium and a heat transfer medium into a heat transfer conduit which extends essentially helically about the reservoir and is thermally coupled with the reservoir; and transferring heat energy between the liquid in the reservoir and the cooling medium or the heat transfer medium in the heat transfer conduit such that the liquid in the first upper region of the reservoir has a lower temperature than the liquid in the second lower region of the reservoir, which results in gravity-driven circulation of the liquid through the circulation conduit from the first circulation connection to the second circulation connection.

12. The method according to claim 11, wherein the reservoir and the heat transfer conduit collectively define a heat exchanger which operates on the countercurrent principle.

13. The method according to claim 11, further comprising:

controlling a flow of cooling medium or heat transfer medium in the heat transfer conduit with a flow control valve arranged in the heat transfer conduit.

14. The method according to claim 11, wherein the heat transfer conduit is a portion of a conduit system through which a cooling medium or a heat transfer medium may flow, the conduit system connected with several reservoirs for providing a cooled or heated liquid onboard an aircraft.

15. The method according to claim 11, wherein supplying the liquid into the reservoir occurs through an inlet connection of the reservoir.

16. The method according to claim 15, wherein when a cooled liquid is to be provided to the aircraft, the inlet connection is provided in the second lower region of the reservoir to receive warm liquid into the reservoir, and wherein when a heated liquid is to be provided to the aircraft, the inlet connection is provided in the first upper region of the reservoir to provide cool liquid into the reservoir.

17. The method of claim 11, further comprising:

withdrawing liquid contained in the reservoir from a dispensing conduit coupled with the circulation conduit.

18. The method according to claim 17, wherein the dispensing conduit includes a further flow control valve configured to withdraw liquid contained in the reservoir.

19. The method according to claim 11, wherein a float valve is arranged in the first upper region of the reservoir.

20. The method according to claim 11, wherein the gravity-driven circulation of liquid through the circulation conduit is continuous such that stagnation of liquid in the reservoir and the circulation conduit is avoided.

* * * * *